US009934629B2

(12) United States Patent
Wittliff

(10) Patent No.: US 9,934,629 B2
(45) Date of Patent: Apr. 3, 2018

(54) VEHICLE MAINTENANCE SYSTEM AND METHOD

(71) Applicants: Bosch Automotive Service Solutions Inc., Warren, MI (US); Robert Bosch GmbH, Stuttgart (DE)

(72) Inventor: William W. Wittliff, Gobles, MI (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 172 days.

(21) Appl. No.: 14/975,114

(22) Filed: Dec. 18, 2015

(65) Prior Publication Data

US 2016/0180607 A1 Jun. 23, 2016

Related U.S. Application Data

(60) Provisional application No. 62/094,129, filed on Dec. 19, 2014.

(51) Int. Cl.

| | |
|---|---|
| ***G07C 7/00*** | (2006.01) |
| ***G07C 5/00*** | (2006.01) |
| *G07C 5/08* | (2006.01) |

(52) U.S. Cl.

CPC ..... *G07C 7/00* (2013.01); *G07C 5/008* (2013.01); *G07C 5/0808* (2013.01); *G07C 2205/02* (2013.01)

(58) Field of Classification Search

CPC ..... G07C 7/00; G07C 5/008

See application file for complete search history.

(56) References Cited

U.S. PATENT DOCUMENTS

2016/0086390 A1* 3/2016 Berkobin ..... G07C 5/008 701/1

* cited by examiner

*Primary Examiner* — Basil T. Jos

(74) *Attorney, Agent, or Firm* — Maginot Moore & Beck LLP

(57) ABSTRACT

A vehicle maintenance system comprising an ECU and a port for interfacing with the ECU, the ECU configured to store diagnostic data related to the vehicle. The system further comprises a dongle configured to interface with the port to send data to the ECU and receive data from the ECU and a local device configured to communicate with the dongle and a remote computer, the local device comprising a display, a memory storing program instructions, and a processor configured to execute the program instructions to establish a communications link with the ECU via the dongle to allow the transfer of diagnostic data from the ECU to the local device, to allow the transfer of the diagnostic data from the local device to the remote computer and to receive data from the remote computer, such that the data received is used to perform a maintenance action on the vehicle.

18 Claims, 5 Drawing Sheets

VEHICLE MAINTENANCE SYSTEM AND METHOD

This application claims the benefit of priority of U.S. provisional application Ser. No. 62/094,129, filed on Dec. 19, 2014 the disclosure of which is herein incorporated by reference in its entirety.

This disclosure relates generally to automotive maintenance systems and particularly to a system and a method for remotely diagnosing vehicle issues.

BACKGROUND

In recent years, vehicles and the field of automotive maintenance have experienced rapid growth in computerized systems both within automotive vehicles and in computerized diagnostic tools that identify maintenance issues with the vehicles. For example, most modern vehicles include one or more computer systems that are often referred to as an electronic control unit (ECU). In some vehicles, the ECU controls and monitors the operations of numerous systems including, but not limited to, the engine, steering, tires, transmission, brakes, fuel delivery or battery level monitoring, and climate control systems. Some vehicles also include numerous sensors that monitor various aspects of the operation of the vehicle. The ECU receives the sensor data and is configured to generate diagnostic trouble codes (DTCs) if the sensors indicate that one or more systems in the vehicle may be failing or operating outside of predetermined parameters.

Many vehicles use a controller area network (CAN) vehicle bus to transmit data between the ECU and the onboard sensors, components, and systems in the vehicle. The CAN bus, or other equivalent data networks in a vehicle, provides a common communication framework between the ECU and the various sensors and systems in the vehicle. Additionally, the CAN bus or equivalent network enables communication between the ECU and external diagnostic tools through a port that is typically accessible from within a cabin of the vehicle near the driver's seat. The ECU and the diagnostic tools interfaced therewith often use an industry standard protocol, such as a version of the on-board diagnostics (OBD) protocol, such as the OBD-II protocol.

In response to determining that the ECU of a vehicle has generated one or more DTCs, a technician may refer to instructions for resolving the issue that has caused the ECU to generate the DTC. Some technicians, particularly technicians that are new to the industry, may be unfamiliar with the procedures described in the instructions and, therefore, may be unable to resolve the issue on their own. In other situations, instructions for resolving the issue that caused the ECU to generate the DTC may be locally unavailable, again leaving the technician unable to resolve the issue. Accordingly, further developments in the area of vehicle diagnostics and repair are desirable.

SUMMARY

According to an exemplary embodiment of the disclosure, a vehicle maintenance system, includes a vehicle, a dongle, and a local device. The vehicle includes a motor, an Electronic Control Unit (ECU) and a port for interfacing with the ECU. The ECU is configured to store diagnostic data related to the motor. The dongle is configured to interface with the port to send data to the ECU and receive data from the ECU. The local device is configured to communicate with the dongle and a remote computer. The local device includes a display, an input unit, a memory storing program instructions, and a processor configured to execute the program instructions. The processor executes the program instructions to establish a communications link with the ECU via the dongle, to transfer the diagnostic data from the ECU to the local device, to transfer the diagnostic data from the local device to the remote computer, to receive data from the remote computer related to the diagnostic data, such that the data received from the remote computer is used to perform a maintenance action on the vehicle.

According to another exemplary embodiment of the disclosure, a method is disclosed for operating a maintenance system for a vehicle. The vehicle includes an electronic control unit (ECU) and a port for interfacing with the ECU. The ECU is configured to store diagnostic data related to the vehicle. The diagnostic data includes diagnostic trouble codes (DTC). The method includes providing a dongle configured to interface with the port to send data to the ECU and receive data from the ECU, providing a local device configured to communicate with the dongle and a remote computer, the local device comprising a display, an input unit, a memory storing program instructions, and a processor configured to execute the program instructions, and mating the dongle with the port to establish a communications link between the dongle and the ECU. The method further includes using the local device to establish a communications link with the ECU via the dongle, using the local device to determine if the vehicle has any DTCs stored in the ECU, transmitting at least one stored DTC to the local device, displaying data associated with the at least one DTC on the local device's display, determining if instruction is needed from a remote technician to resolve an issue associated with the at least one DTC and if instruction is needed, then, establishing a communications link between the local device and a data server to access data regarding at least one remote technician. The method also includes selecting a remote technician to assist in resolving the issue associated with the at least one DTC, receiving by the local device address data associated with the selected remote technician from the data server, sending automatically the at least one DTC to a remote computer associated with the remote technician, and receiving from the remote computer repair information related to repairing the issue associated with the at least on DTC.

According to a further exemplary embodiment of the disclosure, a system is disclosed for performing maintenance on a vehicle. The vehicle includes an electronic control unit (ECU), and a port for interfacing with the ECU. The ECU is configured to store diagnostic data related to the vehicle and at least on sensor for generating diagnostic data. The system includes a dongle and a local device. The dongle is configured to interface with the port to send data to the ECU and to receive data from the ECU, and the dongle includes a transceiver. The local device includes a display, an input unit, a processor, a transceiver operably connected to the processor and configured to wirelessly communicate with the dongle transceiver via a wireless network. The local device also includes a memory storing program instructions and a processor configured to execute the program instructions. The processor executes the program instructions to establish a communications link with the ECU via the dongle, to transfer the diagnostic data from the ECU to the local device, to transfer the diagnostic data from the local device to a remote computer, and to receive data from the remote computer related to the diagnostic data, such that the data received from the remote computer is used to perform a maintenance action on the vehicle.

BRIEF DESCRIPTION OF THE DRAWINGS

The above-described features and advantages, as well as others, should become more readily apparent to those of ordinary skill in the art by reference to the following detailed description and the accompanying figures in which.

DETAILED DESCRIPTION

Figure 1:
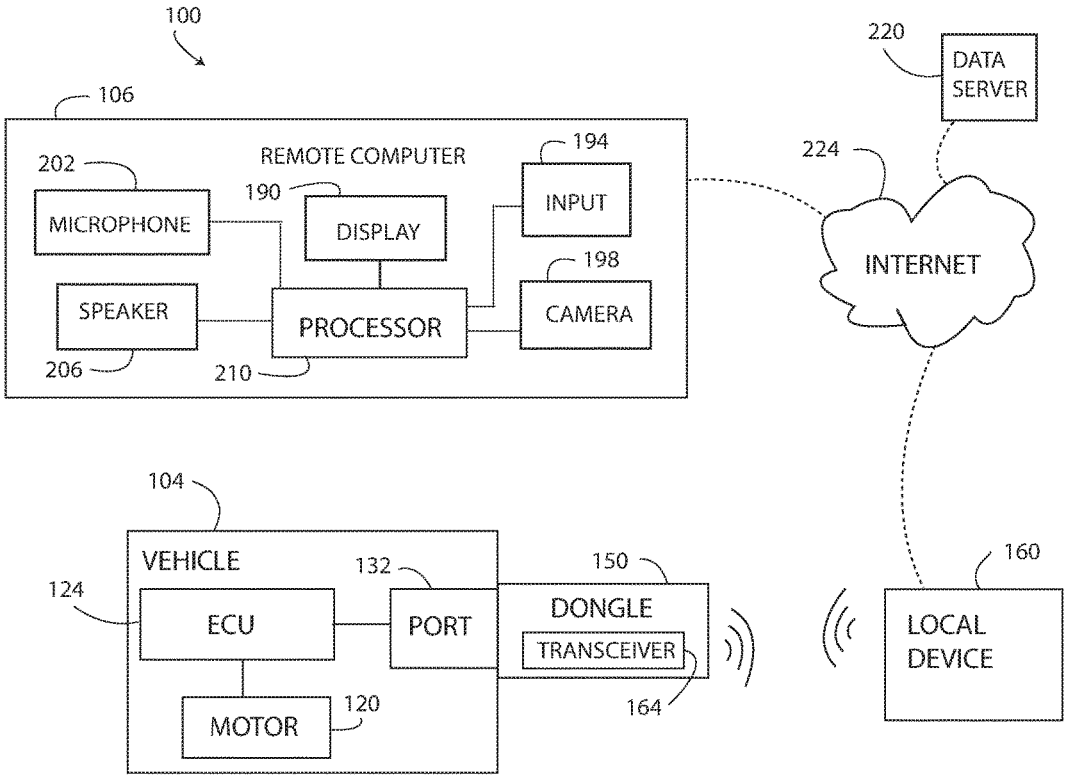
FIG. 1 is a block diagram showing a vehicle maintenance system, as described herein, the vehicle maintenance system is associated with a vehicle and includes a local device and a remote technician device both of which are connected to the Internet.

For the purpose of promoting an understanding of the principles of the disclosure, reference will now be made to the embodiments illustrated in the drawings and described in the following written specification. It is understood that no limitation to the scope of the disclosure is thereby intended. It is further understood that this disclosure includes any alterations and modifications to the illustrated embodiments and includes further applications of the principles of the disclosure as would normally occur to one skilled in the art to which this disclosure pertains.

As shown in FIG. 1, a vehicle maintenance system 100 includes a dongle 150, a local device 160, a remote computer 106, and a data server 220. The maintenance system 100 is shown associated with a vehicle 104 in FIG. 1. The vehicle 104 is representative of any type of vehicle including, but not limited to, passenger motor vehicles, commercial motor vehicles, airplanes, ships, and boats. The exemplary vehicle 104 includes a motor 120, an ECU 124, and a port 132.

The motor 120, in one embodiment, is an internal combustion engine configured to burn fuel stored in a fuel cell (i.e. a fuel tank, not shown) of the vehicle 104. In another embodiment, the motor 120 includes an electric motor configured to receive electrical energy from a chemical fuel cell (not shown) of the vehicle 104. Accordingly, the vehicle 104 may be powered by an internal combustion engine only, an electric motor only, or an internal combustion engine and an electric motor (i.e. a hybrid vehicle).

The ECU 124 is a computer that is configured to monitor various sensors (not shown) that are associated with the motor 120 and other components of the vehicle 104. The ECU 124 generates and stores data related to the operation of the vehicle 104. Exemplary data generated and stored by the ECU 124 includes data indicating if the motor 120, or any of the other vehicle components monitored by the ECU, is operating outside of desired parameters.

The port 132, which is also referred to herein as a connector and/or an OBD connector, is typically located within an interior of the vehicle 104 in a position that is accessible by an operator of the vehicle. The port 132 is electrically connected to the ECU 124 and is a communications interface for interfacing with the ECU. Accordingly, the data generated and stored by the ECU 124 is transmittable to a device that is connected to the port 132. Additionally, data generated/received by a device connected to the port 132 can be transmitted to the ECU 124 through the port.

The dongle 150 is a device that is configured to interface with the port 132 to send data to the ECU 124 and to receive data from the ECU. Additionally, the dongle 150 is configured to send data to the local device 160. In one embodiment, the dongle 150 is a vehicle communication interface (VCI) that includes a wireless transceiver 164, which is also referred to herein as a wireless transmitter and receiver. The transceiver 164 is configured to transmit selected data generated by the ECU 124 to another device, such as the local device 160, using any desired wireless communication protocol. The dongle 150 is configured to obtain data from the ECU 124 via standard vehicle protocols, such as SAE-J1850 VPW, SAE-J1850 PWM, and ISO9141, as well as enhanced data.

Figure 2:
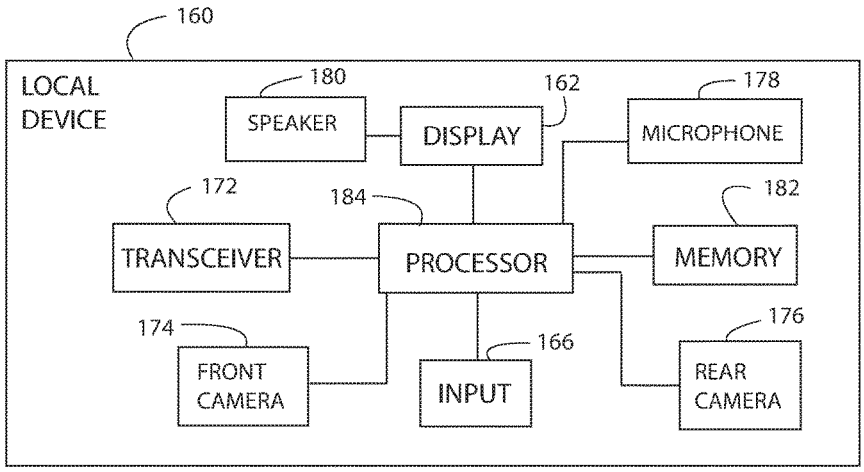
FIG. 2 is a block diagram of the local device of FIG. 1.

As shown in FIG. 2, the local device 160 includes a display 162, an input device 166, a transceiver 172, front camera 174, a rear camera 176, a microphone 178, a speaker 180, and a memory 182 each of which is connected to at least one processor 184. The local device 160 is typically a cellular phone/mobile phone, a smartphone, a tablet computer, or the like.

The display 162 is a liquid crystal display (LCD) panel configured to display text, images, and other visually comprehensible data. The display 162, in another embodiment, is any display as desired by those of ordinary skill in the art, including, but not limited to, an active-matrix organic light-emitting diode display.

The input device 166 is a touchscreen applied over the display 162. The input device 166 is configured to respond to the touch of a finger or a stylus. The input device 166 is configured to enable a user to enter text data and to manipulate objects shown on the display 162. In another embodiment, the input device 166 is a button, a keyboard or any device configured to generate an input signal, as desired by those of ordinary skill in the art.

The transceiver 172, which is also referred to as a wireless transmitter and receiver, is operably connected to the processor 184 and is configured to wirelessly communicate with the transceiver 164 of the dongle 150 either directly or indirectly via a cellular network, a wireless local area network ("Wi-Fi"), a personal area network, and/or any other wireless network. Accordingly, the transceiver 172 and the transceiver 164 are compatible with any desired wireless communication standard or protocol including, but not limited to, Near Field Communication ("NFC"), IEEE 802.11, IEEE 802.15.1 ("Bluetooth"), Global System for Mobiles ("GSM"), and Code Division Multiple Access ("CDMA"). In another embodiment, the local device 160 is connected to the dongle 150 with a hardwired connection (not shown) over which data is transferred between the dongle and the local device.

The cameras 174, 176 are each configured to generate image data representative of an area in a corresponding field of view of the cameras. The front camera 174 is positioned on a side of the local device 160 including the display 162. The rear camera 176 is positioned on an opposite side of the local device 160 from the display 162 and the front camera 174.

The microphone 178 may be a transducer configured to generate electronic sound data based on sounds near the local device 160. The microphone 178 is provided as any desired microphone device.

The speaker 180 may be a transducer that is configured to convert electronic sound data into audible sound waves. The speaker 180 is provided as any desired speaker device.

The processor 184 is configured to execute program instructions (i.e. software) that are stored in the memory 182. The processor 184 is operably connected to the memory 182 and is configured to execute the program instructions for operating the components connected thereto, such as the display 162, the input device 166, the transceiver 172, the cameras 174, 176, the microphone 178, and the speaker 180.

The remote computer 106 includes a display 190, an input 194, a camera 198, a microphone 202, and a speaker 206 each of which is connected to a processor 210. Accordingly, in one embodiment, the remote computer 106 is provided as a desktop computer, a laptop computer, or a tablet computer. In another embodiment, the remote computer 106 is provided as a wireless device that is similar and/or identical to the local device 160.

The display 190 is liquid crystal display (LCD) panel configured to display text, images, and other visually comprehensible data. The display 190, in another embodiment, is any display as desired by those of ordinary skill in the art, including, but not limited to, an active-matrix organic light-emitting diode display.

The input 194 includes a keyboard and mouse (not shown) to enable a user to enter text data and annotation data, and to manipulate objects shown on the display 190. In another embodiment, the input 194 is any device configured to generate an input signal, as desired by those of ordinary skill in the art.

The camera 198 is configured to generate image data representative of an area in a field of view of the camera. In one embodiment, the camera 198 is positioned to generate video data of a user of the remote computer 106.

The microphone 202 may be a transducer configured to generate electronic sound data based on sounds near the remote computer 106. The microphone 202 is provided as any desired microphone device.

The speaker 206 may be a transducer that is configured to convert electronic sound data into audible sound waves. The speaker 206 is provided as any desired speaker device.

Figure 3:
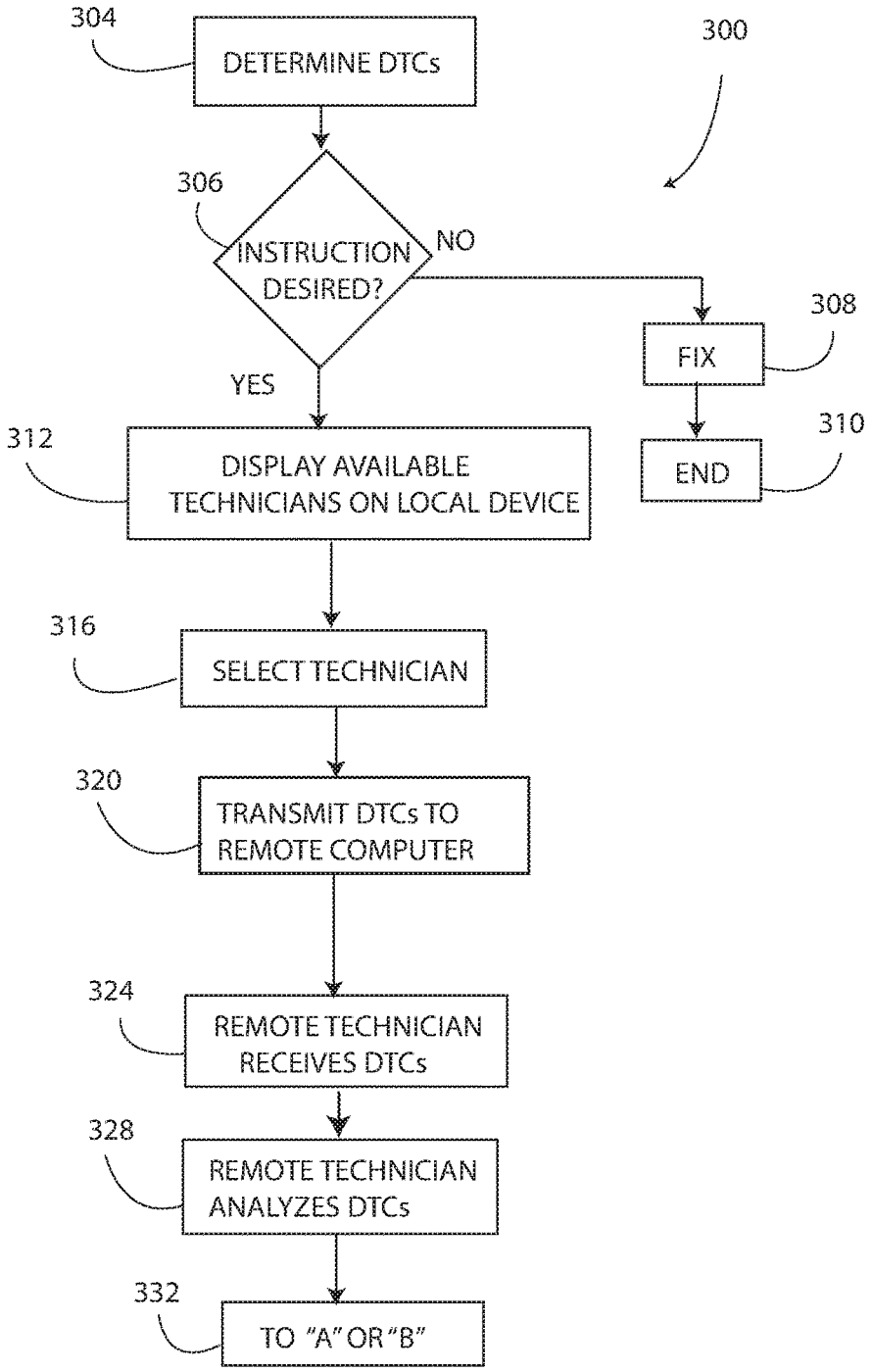
FIG. 3 is a flowchart illustrating an exemplary method of diagnosing and resolving an issue with the vehicle of FIG. 1 using the vehicle maintenance system of FIG. 1.

In operation and as shown in FIG. 3, the maintenance system 100 is configured to implement a method 300 for enabling a local technician to use the local device 160 to diagnose and to resolve issues with the vehicle 104. First, the local technician touches an icon on the display 162 or presses a button of the input 166 to execute the following diagnostic and maintenance program. In block 304, after the icon is pressed, the local device 160 automatically determines if the vehicle 104 has any DTCs stored in the ECU 124. Specifically, the local device 160 sends a command to the dongle 150 that instructs the dongle to determine the DTCs stored in the ECU 124. If DTCs are stored in the ECU 124, then the dongle 150 transmits DTC data to the local device 160. The DTC data are representative of the DTCs stored in the ECU 124. If no DTCs are stored in the ECU 124, the dongle 150 sends data to the local device 160 indicating as such.

In response, to receiving the DTC data from the dongle 150, the local device 160 displays data on the display 162 associated with the DTCs. For example, for each DTC, the DTC and a brief description of the issue associated with the DTC may be shown on the display 162.

Next, in block 306, the diagnostic and maintenance program pauses to allow the local technician time to review and analyze the DTC(s) shown on the display 162 and to determine if he/she desires instruction from a remote technician to perform the task(s) required to resolve the issue(s) that has caused the ECU 124 to generate the DTC(s). If no outside assistance is required, then, in block 308, the local technician resolves the issue(s) and the method 300 ends, as shown in block 310. If, however, the local technician desires instructions and/or other types of assistance, the local technician uses the input 166 to indicate that instruction is desired.

In block 312, in response to the local technician's request for instruction, the local device 160 connects to the data server 220 through the Internet 224 and automatically displays a listing of available remote technicians on the display 162 based on the DTCs of the vehicle, in one embodiment. The data server 220 includes a database of remote technician data that is associated with a plurality of the remote technicians. The technician data is organized by one or more of availability, skill set, location, cost, vehicle make and model training, DTC specialty, among other categories. The availability data category organizes the remote technicians into an available group and an unavailable group. Those technicians in the unavailable group may post an "out of office" or a "do not disturb" message to avoid getting requests for assistance at inopportune times. Those remote technicians in the unavailable ground are presently unavailable to assist the local technician. The vehicle make and model training category associates the remote technicians with at least one manufacturer and at least one vehicle model. For example, if the local technician is servicing a vehicle model manufactured by Company A, the local technician can query the data server 220 for remote technicians qualified to service vehicles manufactured by Company A and then a listing of the qualified remote technicians is shown on the display 162. The DTC specialty category enables the local technician to query the data server 220 for remote technicians that are capable of resolving issues with a particular DTC and then to show a list of those remote technicians on the display 162.

In block 316, the local technician uses the input 166 to select a desired remote technician. Upon selection of a remote technician, the data server 220 automatically sends address data to the local device 160, and sends the DTC data to the remote computer 106 (block 320). The local device 160 automatically connects to the remote computer 106 of the remote technician using the address data so that data can be transferred between the devices 106, 160. Also, when the local device 160 is electrically connected to the remote computer 106 the local technician and the remote technician can speak to each other and hear each other using the corresponding microphones 178, 202 and speakers 180, 206.

Next, in blocks 324 and 328, the remote technician automatically receives the DTCs (as shown on the display 190) and analyses the DTCs to determine an appropriate resolution. During the analysis period, the remote technician may access instructions for resolving the issue that has generated the DTCs. The instructions may be stored on the remote computer 106 or may be available on the data server 220 and/or the Internet 224. The remote technician may also already know the proper procedure for resolving the issue(s) that has caused the DTCs and not have to refer any instructions.

Figure 4:
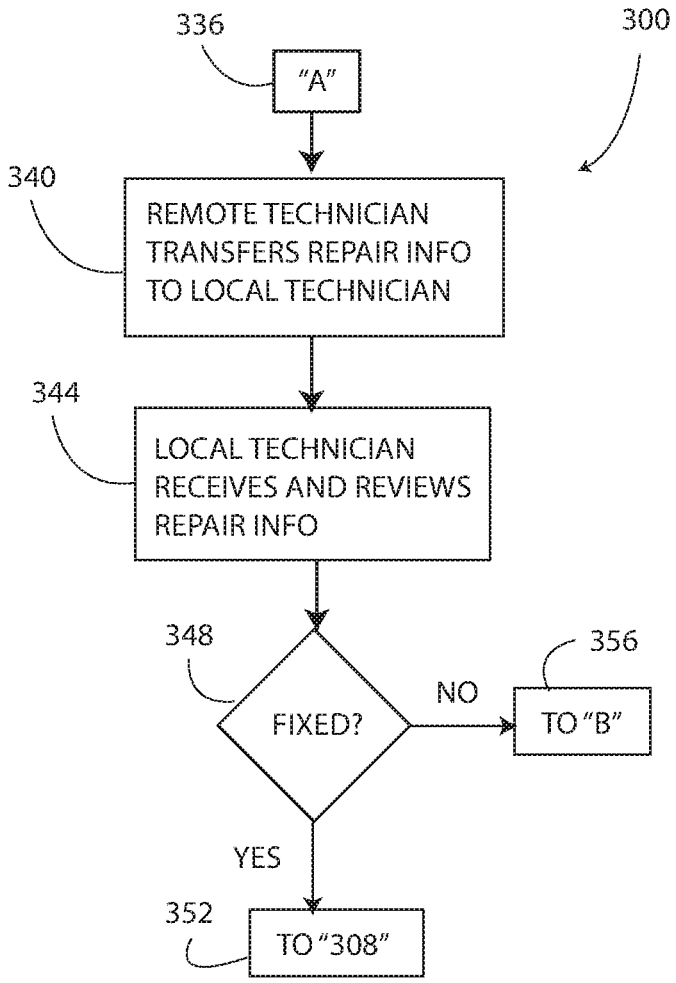
FIG. 4 is a flowchart illustrating a portion of the method of FIG. 3 in which a remote technician sends technical information to the local technician to assist the local technician in resolving the issue with the vehicle.
Figure 5:
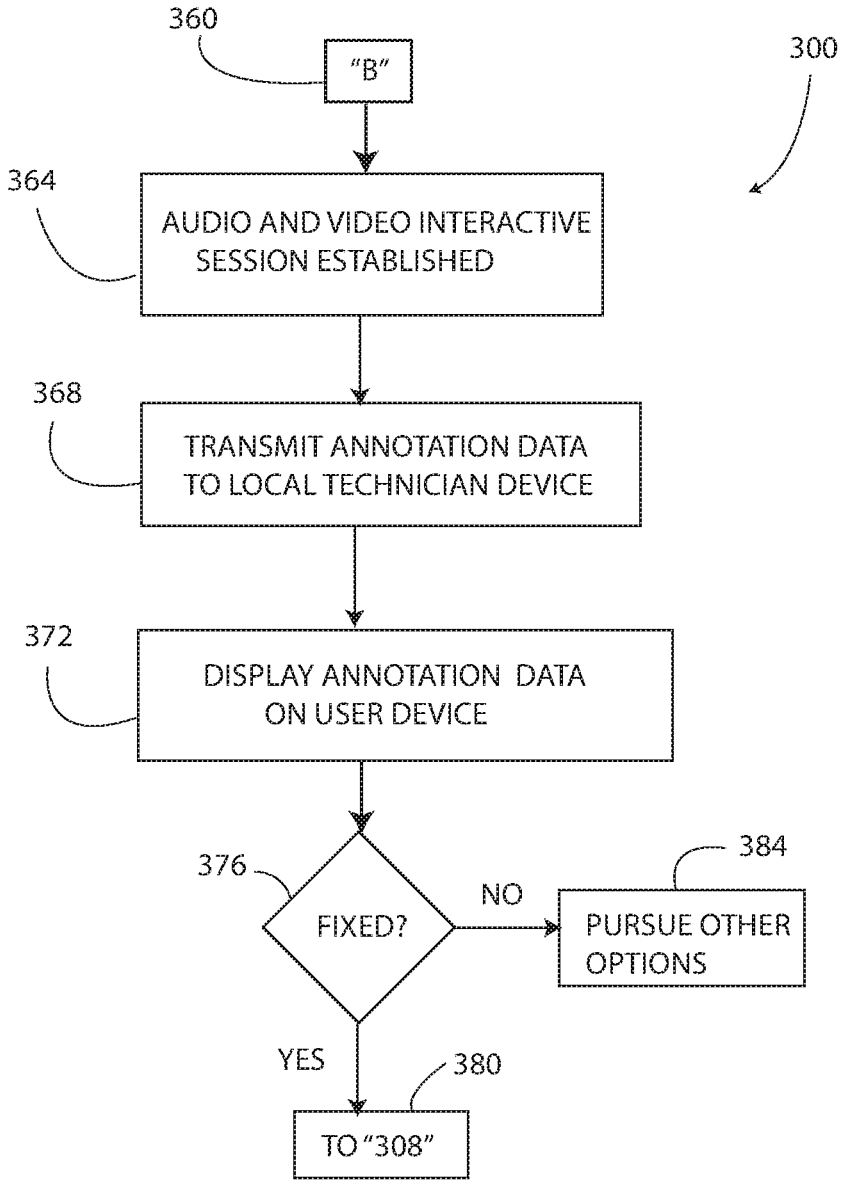
FIG. 5 is a flowchart illustrating another portion of the method of FIG. 3 in which an audio and video interactive session is established using the local device and the remote technician device.

Next, in block 332 the method 300 progresses to one of two types of interactive sessions, which are established between the local device 160 and the remote computer 106. As shown in blocks 336 and 340 of FIG. 4, in the first in type of interactive session (i.e. Type A), the remote technician electronically transfers repair instructions to the local device 160. Additionally, during the Type A interactive session the local technician and the remote technician may speak to each other using the microphones 178, 202 and speakers 180, 206. The repair instructions sent to the local device 160, may include electronic documents having text and image based instructions for repairing the vehicle 104. The repair instructions may also include electronic video files that depict another technician resolving the same or a similar issue. The repair instructions may also include electronic audio files having audible instructions for repairing the vehicle 104. Any other desired electronic file may also be included in the repair instructions.

In block 344, the local technician reviews the repair instructions. Additionally, the local technician and the remote technician may speak to each other using the microphones 178, 202 and speakers 180, 206. As described in block 348, if after reviewing the instructions the local technician determines that no further assistance is needed, the method 300 ends and the local technician proceeds to the repair the vehicle 104 according to the instructions. If, however, after reviewing the instructions the local technician requires additional instruction, then the second type (i.e. Type B) of interactive session is established between the local device 160 and the remote computer 106.

As described in blocks 360 and 364, the Type B interactive session includes establishing a video and audio link between the local device 160 and the remote computer 106. During the Type B interactive session, the remote technician may use the camera 198 to send image data of himself/herself and/or of an explanatory device that may assist the local technician in resolving the issue with the vehicle 104. The image data generated by the camera 198 is shown on the display 162 of the local device 160. Additionally, during the Type B interactive session, the remote technician may electrically send documentation or other electronic files related to the issue to be resolved to the local technician over the Internet 224 to the local device 160. Additionally, during the Type B interactive session the local technician and the remote technician may speak to each other using the microphones 178, 202 and speakers 180, 206.

Also, during the Type B interactive session, the local technician may use the camera 174, 176 to generate image data of the vehicle 104, which is transmitted to the remote computer 106, and shown on the display 162 as a video for viewing by the remote technician in real time. By enabling the remote technician to view a desired portion of the vehicle 104, the remote technician may provide recommendations and instructions specific to the vehicle that may differ the default instructions or the default procedure. For example, if the vehicle 104 has been modified with aftermarket parts, instructions that differ from default instructions may be necessary to resolve the issue that has generated the DTC.

When transmitting the image data to the remote computer 106, the local technician directs one of the cameras 174, 176 of the local device 160 at an area of interest of the vehicle 104. The image data is shown on the display 162 of the local device 160 and is also shown on the display 190 of the remote computer 106. When viewing the image data, the remote technician makes recommendation and describes procedures specific to the vehicle 104. Additionally, the remote technician can hear sounds generated by the vehicle 104 as detected by the microphone 178. The sounds may assist the remote technician in determine the best approach for resolving the issue with the vehicle 104.

Figure 6:
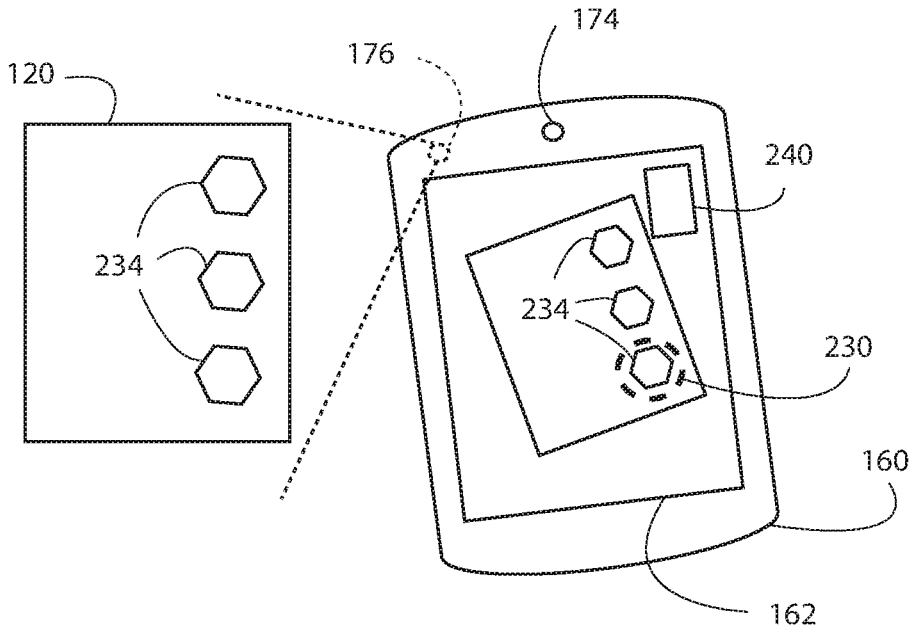
FIG. 6 is a block diagram view of a motor of the vehicle of FIG. 1, the local device, and the remote technician device, annotation data formed by the remote technician is shown on a display of the local device and a display of the remote technician device.
Figure 6:
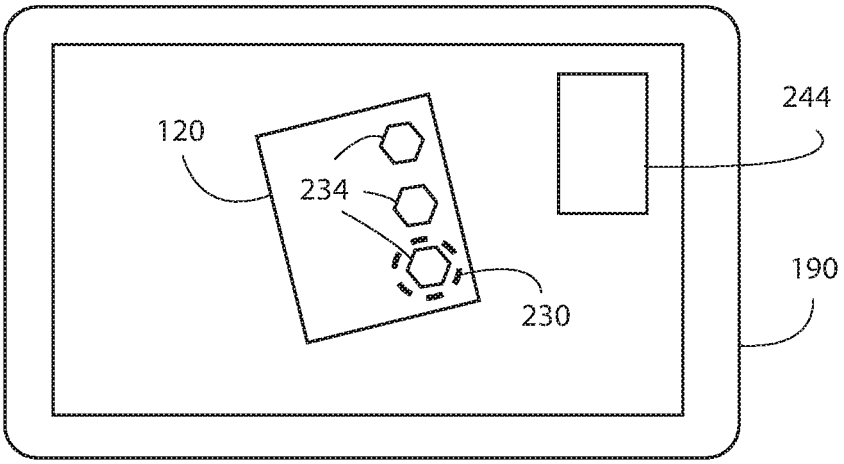

In blocks 368 and 372, and as shown in FIG. 6, the remote technician may use the input 194 to make annotations 230 that are overlaid upon the image data generated by the camera 174, 176. Annotation data associated with the annotations 230 are transmitted to the local device 160 and shown on the display 162 along with the image data generated by the camera 174, 176. In particular, the annotation data are overlaid upon the image data on the display 162 so that the local technician is able to see the image data of the vehicle 104 and the annotations 230 at the same time. The annotations 230 may include arrows, boxes, highlighting, or any other indicia that assists in identifying a selected portion of the image data.

In one example, if the motor 120 of the vehicle 104 includes three fasteners 234, one of which must be removed (the bottom one), the local technician positions the three fasteners in the field of view of the camera 176. The local technician confirms the three fasteners 234 are in the field of view of the camera 176 by monitoring the display 162, which shows the image data. The image data is sent to the remote technician who views image data showing the three fasteners 234 on the display 190 and then verbally identifies the fastener 234 to be removed and/or applies an annotation 230 to the image data that encircles the fastener 234 to be removed. The local technician hears the verbal identification from the speaker 180 and sees the annotation 230 on the display 162 positioned over the fastener 234 to be removed.

In response to the instruction provided by the remote technician, the local technician proceeds to remove the fastener 234 while maintaining the fastener within the field of view of the camera 176. The remote technician monitors the image data and to confirm that the correct fastener 234 is being removed and that the proper approach is being followed for resolving the vehicle 104 issue. In this way, a local technician without the skill set to resolve an issue may be guided through a procedure required to resolve the issue by a remote technician that can confirm that the procedure is followed by monitoring the image data on the display 190. The transmission of image data and/or sound data may continue until the issue is resolved or until the local technician determines that he/she is capable of resolving the issue independently.

During the Type B interactive session the image data generated by the camera 174 may be shown in a "window" 240 of the display 162 of the local device 160, and the image data generated by the camera 198 may be shown in a "window" 244 of the display 190 of the remote computer 106. In this way, the local technician and the remote technician may have a video and audio communication session and may also view the image data being viewed by the other party during the communication session.

In block 376, the remote technician and the local technician determine if the issue with the vehicle 104 has been resolved. In block 380, if the issue has been resolved the interactive session ends. In block 384, if the issue has not been resolved, then the local technical pursues other avenues of resolving the issue, such as selecting a different remote technician or any other course of action.

In another embodiment, after the local technician selects a remote technician the local technician is able to select either a Type A or a Type B interactive session.

The vehicle maintenance system 100 is a cost effective way to utilize the skills of an experienced remote technician since the remote technician is not required to drive from jobsite to jobsite and the vehicle 104 does not need to be brought to the location of the remote technician. In one embodiment, the remote technician is paid by the hour and the duration of the session with the local technician is logged and saved to the remote computer.

In another embodiment, the vehicle 104 uses an Ethernet connection, such as a diagnostic over Internet Protocol (DoIP) to transmit data between the ECU 124 and the onboard sensors, components, and systems in the vehicle. The DoIP, or other equivalent data networks in the vehicle 104, provides a communication framework between the ECU 124 and the various sensors and systems in the vehicle. The DoIP transmits/receives the information to/from an external device, such as the local device 160. The external device can be for instance a tablet, a smart cellular phone, a computer unit, a wearable device, a diagnostic tool, a scan tool, or the like. Therefore, in some embodiments, the dongle 150 is not required and yet the automotive maintenance system 100 is able to perform, deliver, and achieve the results as described above.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A vehicle maintenance system, comprising:

a vehicle having a motor, an Electronic Control Unit (ECU) and a port for interfacing with the ECU, the ECU configured to store diagnostic data related to the motor;

a dongle configured to interface with the port to send data to the ECU and to receive data from the ECU; and a local device configured to communicate with the dongle and a remote computer, the local device comprising a display, an input unit, a memory storing program instructions, and a processor configured to execute the program instructions to establish a communications link with the ECU via the dongle, to transfer the diagnostic data from the ECU to the local device, to transfer the diagnostic data from the local device to the remote computer, to receive data from the remote computer related to the diagnostic data, such that the data received from the remote computer is used to perform a maintenance action on the vehicle, wherein the local device is further configured to communicate with a data server, the data server having a database of remote technician data that is associated with a plurality of remote technicians, whereby a local technician using the local device can select a remote technician of the plurality of remote technicians to assist with the maintenance action using the remote computer.

2. The vehicle maintenance system of claim 1, wherein the local device further includes a transceiver operably connected to the processor and configured to wirelessly communicate with a transceiver of the dongle via a wireless network.

3. The vehicle maintenance system of claim 1, wherein the local device communicates with the dongle to transfer the diagnostic data from the ECU to the local device via a hardwired connection.

4. The vehicle maintenance system of claim 1, wherein the local device further comprises at least one camera, a speaker, and a microphone and the remote computer further comprises at least one camera, a speaker, and a microphone, whereby the local technician and the remote technician can communicate interactively with respect to the diagnostic data.

5. The vehicle maintenance system of claim 1, wherein the vehicle further comprises at least one sensor and an Ethernet connection, whereby the Ethernet connection allows the ECU to communicate with the at least one sensor and the local device.

6. The vehicle maintenance system of claim 1, wherein the local device is selected from a group comprising a tablet computer, a smart cellular phone, a computer unit, a wearable device, a diagnostic device and a scan device.

7. A method for operating a maintenance system for a vehicle, the vehicle including an electronic control unit (ECU) and a port for interfacing with the ECU, the ECU configured to store diagnostic data related to the vehicle, the diagnostic data comprising diagnostic trouble codes (DTC), the method comprising:

providing a dongle configured to interface with the port to send data to the ECU and receive data from the ECU;

providing a local device configured to communicate with the dongle and a remote computer, the local device comprising a display, an input unit, a memory storing program instructions, and a processor configured to execute the program instructions;

mating the dongle with the port to establish a communications link between the dongle and the ECU;

using the local device, establish a communications link with the ECU via the dongle;

using the local device, determine if the vehicle has any DTCs stored in the ECU;

transmitting at least one stored DTC to the local device;

displaying data associated with the at least one DTC on the local device's display;

determining if instruction is needed from a remote technician to resolve an issue associated with the at least one DTC and if instruction is needed, then;

establishing a communications link between the local device and a data server to access data regarding at least one remote technician;

selecting a remote technician to assist in resolving the issue associated with the at least one DTC;

receiving by the local device address data associated with the selected remote technician from the data server;

sending automatically the at least one DTC to a remote computer associated with the remote technician; and receiving from the remote computer repair information related to repairing the issue associated with the at least on DTC.

8. The method of claim 7, wherein the data server data regarding the at least one technician is organized by one or more of availability, skill set, location, cost, vehicle make training, vehicle model training, and DTC specialty.

9. The method of claim 8, wherein the availability data is organized into an available group of remote technicians and an unavailable group of remote technicians.

10. The method of claim 7, wherein the local device further comprises at least one camera, a speaker, and a microphone and the remote computer further comprises, a display, a processor, at least one camera, a speaker, an input unit and a microphone whereby the local technician and the remote technician can communicate interactively with respect to the at least one DTC.

11. The method of claim 10 comprising the additional steps of:

establishing a video and audio link between the local device and the remote computer;

sending by the remote computer, image data to the local device; and rendering the image data on the display of the local device.

12. The method of claim 10 comprising the additional steps of:

generating image data of the vehicle with the at least one camera of the local device;

rendering the image data on the display of the local device;

transmitting the image data to the remote computer; and rendering the image data on the remote computer's display;

wherein the image data may be viewed simultaneously on the local device and the remote computer.

13. The method of claim 12 comprising the additional steps of:

annotating the image data rendered on the remote computer's display; and transmitting the annotation to the local device such that the annotation is shown on the local device's display overlaid on the image data.

14. The method of claim 7, wherein the vehicle further comprises at least one sensor and an Ethernet connection, whereby the Ethernet connection allows the ECU to communicate with the at least one sensor and the local device.

15. The method of claim 7, wherein the local device is selected from a group comprising a tablet computer, a smart cellular phone, a computer unit, a wearable device, a diagnostic device and a scan device.

16. A system for performing maintenance on a vehicle, the vehicle including an electronic control unit (ECU), and a port for interfacing with the ECU, the ECU configured to store diagnostic data related to the vehicle and at least one sensor for generating diagnostic data, the system comprising:

a dongle configured to interface with the port to send data to the ECU and to receive data from the ECU, the dongle including a transceiver;

a local device comprising a display, an input unit, a processor, a transceiver operably connected to the processor and configured to wirelessly communicate with the dongle transceiver via a wireless network, a memory storing program instructions, and a processor configured to execute the program instructions to establish a communications link with the ECU via the dongle, to transfer the diagnostic data from the ECU to the local device, to transfer the diagnostic data from the local device to a remote computer, and to receive data from the remote computer related to the diagnostic data, such that the data received from the remote computer is used to perform a maintenance action on the vehicle, wherein the local device is further configured to communicate with a data server, the data server having a database of remote technician data that is associated with a plurality of remote technicians, whereby a local technician using the local device can select a remote technician of the plurality of remote technicians to assist with the maintenance action using the remote computer.

17. The system of claim 16, wherein the local device further comprises at least one camera, a speaker, and a microphone, and the remote computer further comprises a processor, an input device, at least one camera, a speaker, and a microphone, whereby the local technician and the remote technician can communicate interactively with respect to the diagnostic data.

18. The system of claim 16 wherein the local device is selected from a group comprising a tablet computer, a smart cellular phone, a computer unit, a wearable device, a diagnostic device and a scan device and the remote computer is selected from a group comprising a tablet computer, a smart cellular phone, a computer unit, a wearable device, a diagnostic device and a scan device.

* * * * *